US007108237B2

(12) United States Patent
Gauselmann

(10) Patent No.: US 7,108,237 B2
(45) Date of Patent: Sep. 19, 2006

(54) MOUNTING BRACKET FOR A GAMING MACHINE

(75) Inventor: Michael Gauselmann, Espelkamp (DE)

(73) Assignee: Atronic International GmbH, Lübbecke (DE)

( * ) Notice: Subject to any disclaimer, the term of this patent is extended or adjusted under 35 U.S.C. 154(b) by 588 days.

(21) Appl. No.: 10/346,593

(22) Filed: Jan. 17, 2003

(65) Prior Publication Data

US 2004/0142752 A1 Jul. 22, 2004

(51) Int. Cl.
*A47B 96/06* (2006.01)

(52) U.S. Cl. ..... 248/220.22; 436/29; 436/46

(58) Field of Classification Search ..... 248/220.22, 248/220.21, 225.11, 224.51, 224.61, 551; 70/50, 51, 52; 312/111, 198, 223.1; 463/29.46
See application file for complete search history.

(56) References Cited

U.S. PATENT DOCUMENTS 3,822,049 A * 7/1974 Saunders ..... 248/223.41
5,678,679 A 10/1997 Berman
5,692,722 A * 12/1997 Lundag.ang.rds ..... 248/553
5,860,861 A * 1/1999 Lipps et al. ..... 463/36
6,042,115 A 3/2000 Ward
6,081,420 A * 6/2000 Kim et al. ..... 361/681
6,371,424 B1 * 4/2002 Shaw ..... 248/222.12
6,481,679 B1 * 11/2002 Bennett et al. ..... 248/224.51
2002/0060124 A1 5/2002 Thompson

FOREIGN PATENT DOCUMENTS

GB 2 329 995 A 4/1999

OTHER PUBLICATIONS

European Search Report, 3 pages.

* cited by examiner

*Primary Examiner*—A. Joseph Wujciak, III
(74) *Attorney, Agent, or Firm*—Patent Law Group LLP; Brian D. Ogonowsky

(57) ABSTRACT

A mounting bracket for a slot machine is disclosed herein, where the slot machine is slid onto the mounting bracket. The mounting bracket insures proper alignment of the slot machine onto the platform and secures the slot machine into position.

12 Claims, 6 Drawing Sheets

MOUNTING BRACKET FOR A GAMING MACHINE

FIELD OF THE INVENTION

This invention relates to gaming machines, such as slot machines and, in particular, to a method and structure for mounting a slot machine onto a platform.

BACKGROUND

A typical slot machine has a height of between 1 and 1.5 meters. Typically, the casino provides a platform for a slot machine to raise the machine up to a convenient level for the average player. The platform is typically wood laminated with a plastic material. This platform typically has a hole to allow electrical cables to extend from the slot machine, into the hollow platform, and to a conduit running through the casino. These platforms typically also have within them a receptacle for coins diverted from the slot machine's coin hopper when the hopper is full. The diverted coins pass through a coin drainage hole in the bottom of the slot machine that aligns with a coin drainage hole in the platform leading to the receptacle.

The slot machines must be securely fastened to the platform. The typical method for mounting a slot machine on the platform is to carefully place the slot machine on the platform, then affix the base of the slot machine to the platform using screws, where the heads of the screws are accessed by the installer reaching into the slot machine. Typically, four screws are needed to prevent the slot machine from tipping and to prevent rotation of the slot machine on the platform. Accessing and tightening the screws are difficult. It is also difficult to position the extremely heavy slot machine accurately on the platform. The same installation process needs to be done when the installed slot machine is replaced with a different slot machine.

Accordingly such mounting is difficult, time-consuming, and a distraction to players in the area.

SUMMARY

A mounting bracket for a slot machine is disclosed herein, where the slot machine is slid onto the mounting bracket. The mounting bracket ensures proper alignment of the slot machine onto the platform and secures the slot machine into position.

Since the mounting bracket is light and easy to manipulate, it is very easy to accurately secure the mount to the platform. The position of the mount defines the ultimate position of the slot machine.

Since a single mounting bracket can be used with a variety of slot machines, one slot machine can be removed and quickly replaced with another slot machine.

DETAILED DESCRIPTION

Although the present invention may be used with any type of slot machine, one particular slot machine will be described as an example.

Figure 1:
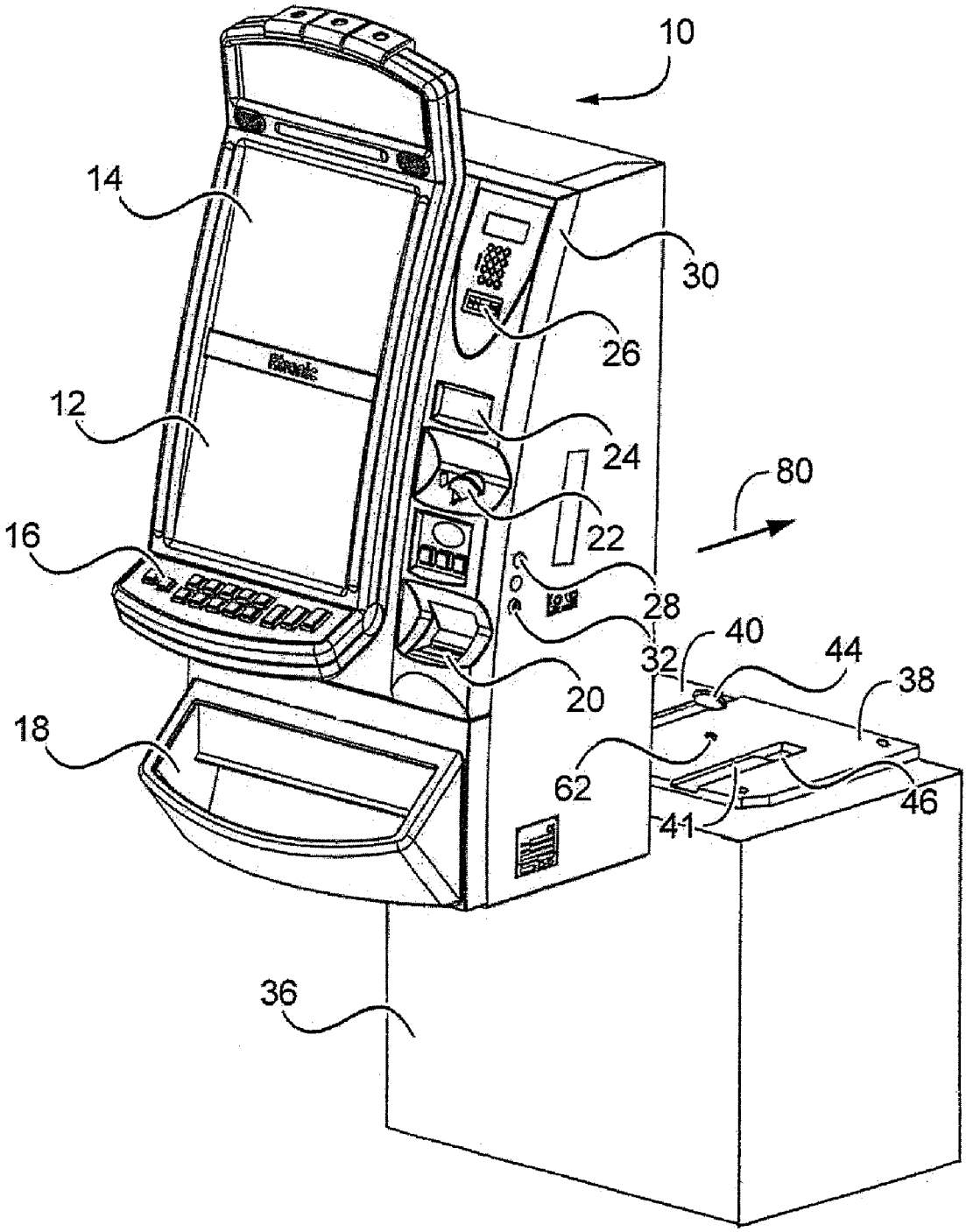
FIG. 1 illustrates a slot machine being slid into place on a mounting bracket in accordance with one embodiment of the invention.

In FIG. 1, slot machine 10 includes display screens 12 and 14 for displaying the game and any other information. One type of game may be the video display of rotatable reels which stop to display random combinations of symbols, where awards are based upon the combinations of symbols across pay lines. Machine 10 may also be the type that includes motor-driven reels.

Buttons 16 control various aspects of the game such as bet, bet max, spin reels, cash out, and any other suitable control. A coin tray 18 receives coins dispensed by a coin hopper upon a win or upon a player cashing out. In some other types of slot machines, coins are not paid out to players but, instead, payment is in the form of crediting a magnetic strip on a plastic card inserted into the machine, crediting a smart card, issuing a paper ticket with a bar code, or any other form of cashless payment. A bill slot 20 receives paper currency, and a coin slot 22 receives coins. A slot 24 may be used for receiving a paper ticket that contains a code for issuing credits to the machine and for dispensing a printed paper ticket. An additional slot 26 may be used for receiving a smart card or a plastic card having a magnetic strip for cashless play.

Figure 6:
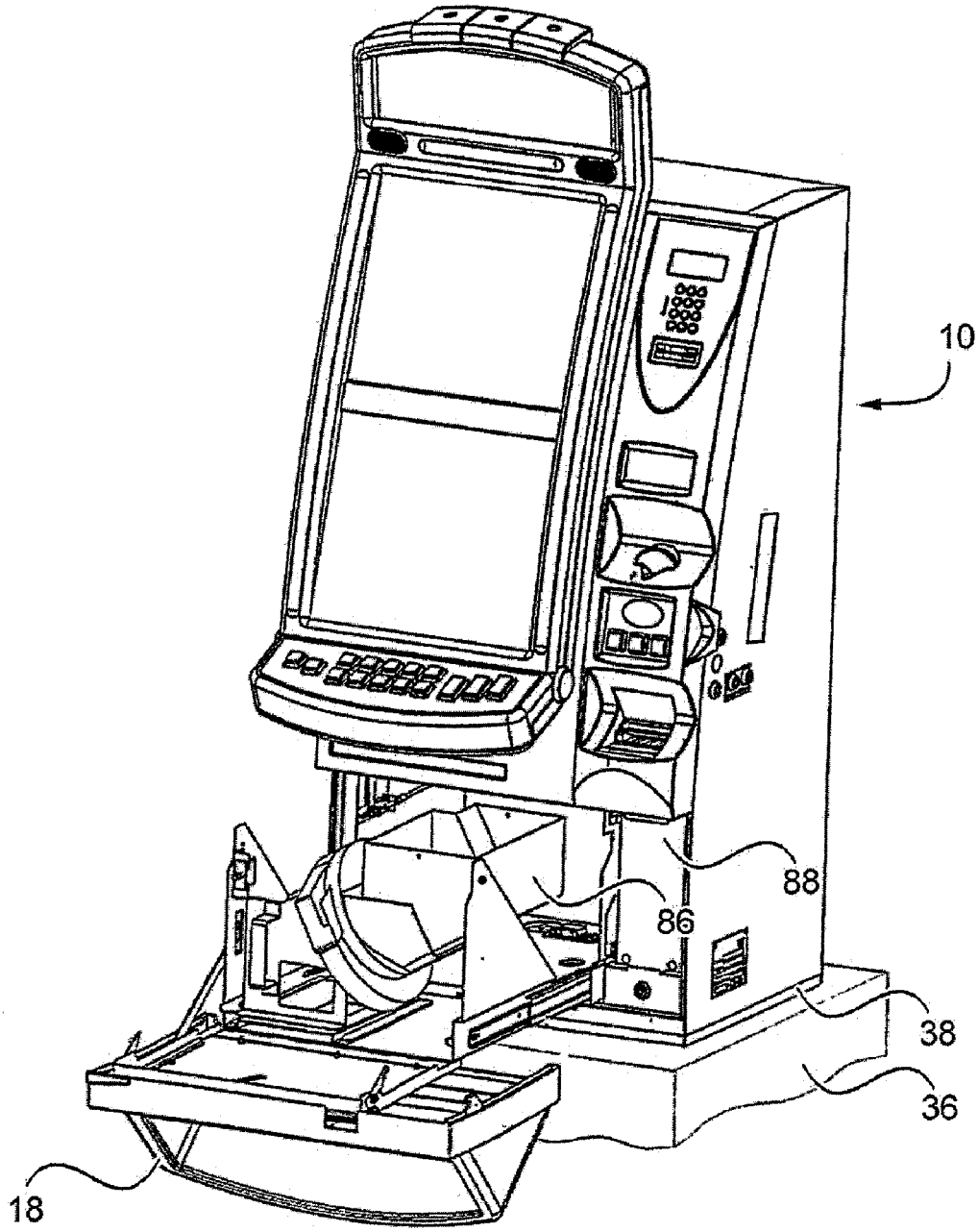
FIG. 6 illustrates how a coin hopper and coin tray are installed in the slot machine after the slot machine is secured to the mounting bracket.

A first lock 28 opens the front door 30 of the machine, and a bottom lock 32 allows an attendant to slide coin tray 18 to the left to gain access to a bill stacker and even pull coin tray out like a drawer to gain access to the coin hopper (see FIG. 6).

A platform 36, typically formed of wood having a laminated plastic surface, raises slot machine 10 to a height convenient for the players. Platform 36 is typically provided with a lockable door to gain access to wiring and a coin receptacle.

A mounting bracket 38 is secured to platform 36 by screws and is used for easy mounting of the slot machine to platform 36, as will be described in detail below.

Figure 2:
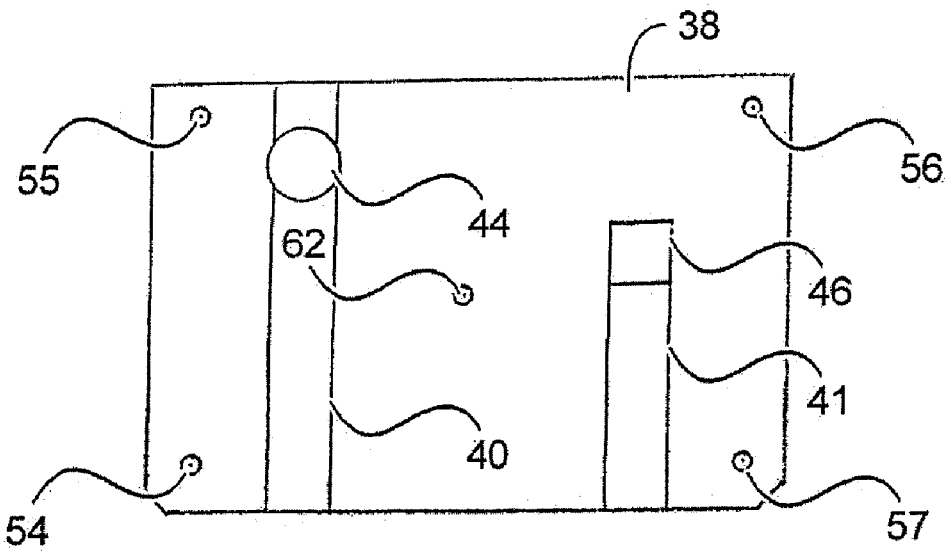
FIG. 2 is a top-down view of the mounting bracket.

FIG. 2 is a top-down view of mounting bracket 38. In one embodiment, bracket 38 is approximately the same width and depth as the slot machine 10 for which it is to support. In one embodiment, the bracket dimensions are approximately 0.55×0.36 meters, with a thickness of 1–2 cm. Bracket 38 may be made of a plastic or other suitable material.

Figure 3:
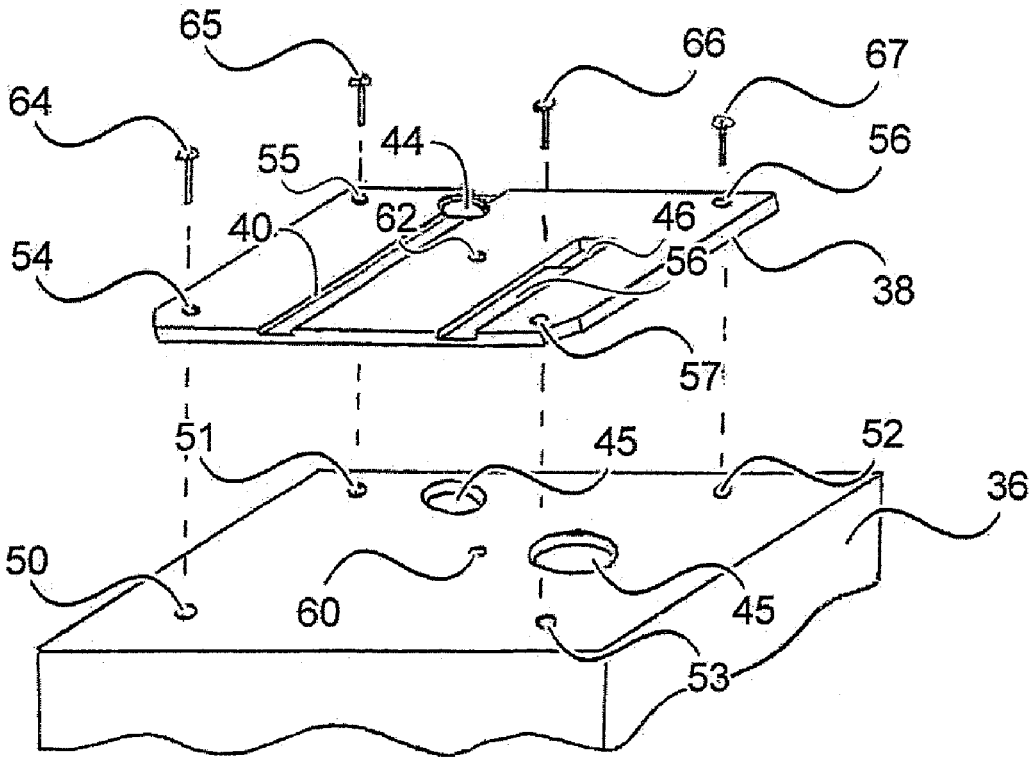
FIG. 3 illustrates the affixing of the mounting bracket to the platform.

FIG. 3 is a perspective view of bracket 38 and platform 36 showing how bracket 38 is secured to platform 36. Bracket 38 includes two grooves 40 and 41 about half the thickness of bracket 38. A hole 44, having a diameter of approximately 55 mm, in bracket 38 allows power and data (if any) cables to be routed from within platform 36, through platform hole 45, and into slot machine 10. When the slot machine's coin hopper is full, a coin drainage hole 46 in bracket 38 allows incoming coins diverted from the coin hopper to be drained through hole 46 and through a corresponding hole 48, having a diameter of approximately 80 mm, in platform 36. The coins then drop into a receptacle within the hollow platform 36.

Bracket 38 may be used as a template for placing on platform 36 to show the installer where to drill holes 45 and 48 as well as to indicate where to drill the bracket mounting holes 50, 51, 52, and 53 (10 mm) to align with preformed holes 54, 55, 56 and 57 in bracket 38. The installer also drills a center hole 60, aligned with hole 62 in bracket 38, for a bolt that secures the slot machine to mounting bracket 38 and platform 36, to be described later. Instead of using bracket 38 as a template, a paper template may be provided.

Screws 64, 65, 66, and 67 then secure bracket 38 to platform 36. Since there is easy access to the screws, it is easy for the installer to secure bracket 38 onto platform 36.

Figure 4:
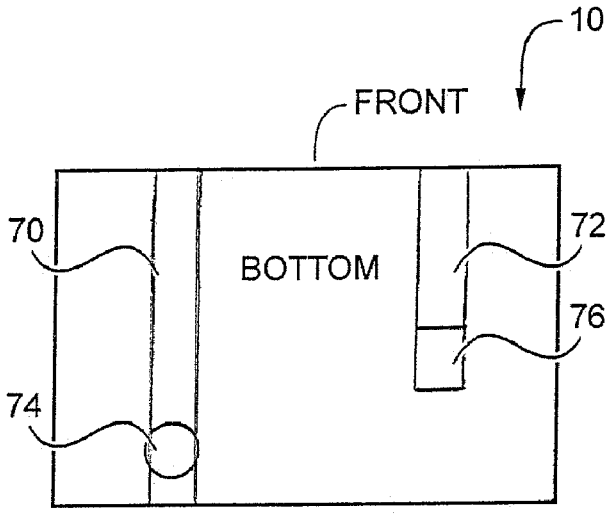
FIG. 4 is a bottom view of the slot machine of FIG. 1 showing the raised tracks that fit within the grooves of the mounting bracket.

FIG. 4 is a bottom view of slot machine 10 showing raised tracks 70 and 72 on the bottom of machine 10 that correspond to grooves 40 and 41, respectively, in bracket 38. Tracks 70 and 72 may be metal or plastic strips secured to a flat bottom of machine 10. A hole 74 for power and data cables aligns with hole 44 in bracket 38, and a coin drainage hole 76 in the bottom of machine 10 aligns with hole 46 in bracket 38.

As illustrated in FIG. 1, slot machine 10 is slid in the direction of arrow 80 so that its tracks enter the grooves in bracket 38. Machine 10 is prevented from being slid too far due to groove 41 ending before the back edge of bracket 38.

Figure 5:
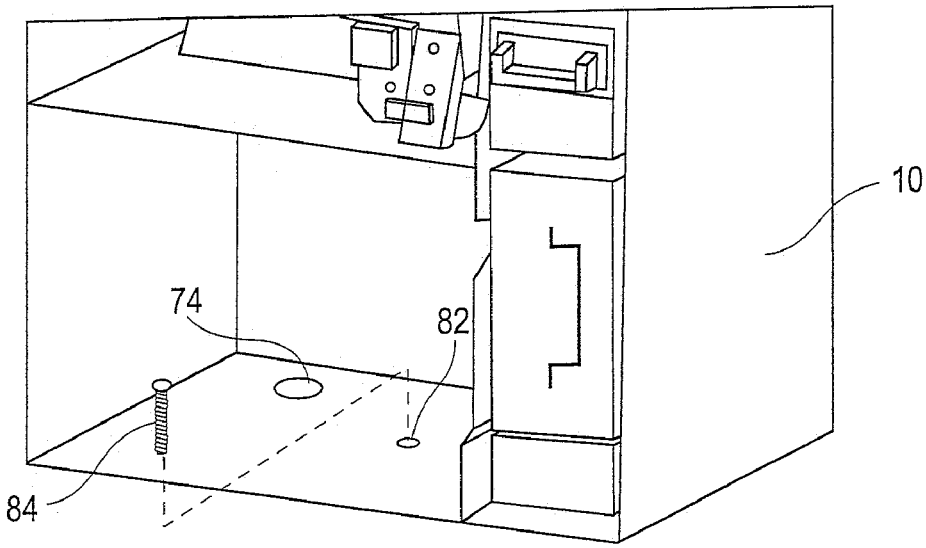
FIG. 5 illustrates a portion of the inside of the slot machine illustrating one technique for securing the slot machine to the bracket.

When machine is in place on bracket 38, machine 10 is then firmly secured to bracket 38 and platform 36 as shown in FIG. 5. FIG. 5 illustrates a bottom portion of slot machine 10 with the coin tray 18 and coin hopper not yet installed. This provides easy access to the bottom plate of machine 10. A hole 82 is formed in the bottom plate of machine 10 that aligns with hole 62 in bracket 38. A bolt or screw 84 is then inserted through hole 82 and firmly tightened to secure machine 10 to platform 36. A power and data cable hole 74 aligns with hole 44 in bracket 38. The coin drainage hole is obscured in FIG. 5.

A power cord is then run up through the cable holes 45, 44, and 74 into machine 10 for connection to a suitable AC power connector. If machine 10 is to be connected to a network, data cables are also run from platform 36 into machine 10 through the cable holes. The data cables are connected to a suitable connector in machine 10.

FIG. 6 illustrates machine 10 secured to platform 36 with coin hopper 86 and coin tray 18 being installed in machine 10. Coin hopper 86 is mounted on a drawer, which is then slid into machine 10. Coin tray 18 is mounted on a hinge so as to allow an attendant to gain full access to coin hopper 86 to either fill or empty coin hopper 86 after machine 10 has been in use. To close the bottom portion, coin tray 18 is pivoted upward so as to latch into position. The drawer is then closed, and coin tray 18 is slid to the right to block access to a bill stacker 88.

A sensor senses when the hopper exceeds a certain weight, indicating that the coins will soon overflow. In response, a coin diverter, forming part of the coin-in mechanism, diverts the incoming coins to the coin drainage hole in the bottom of the slot machine.

Figure 7:
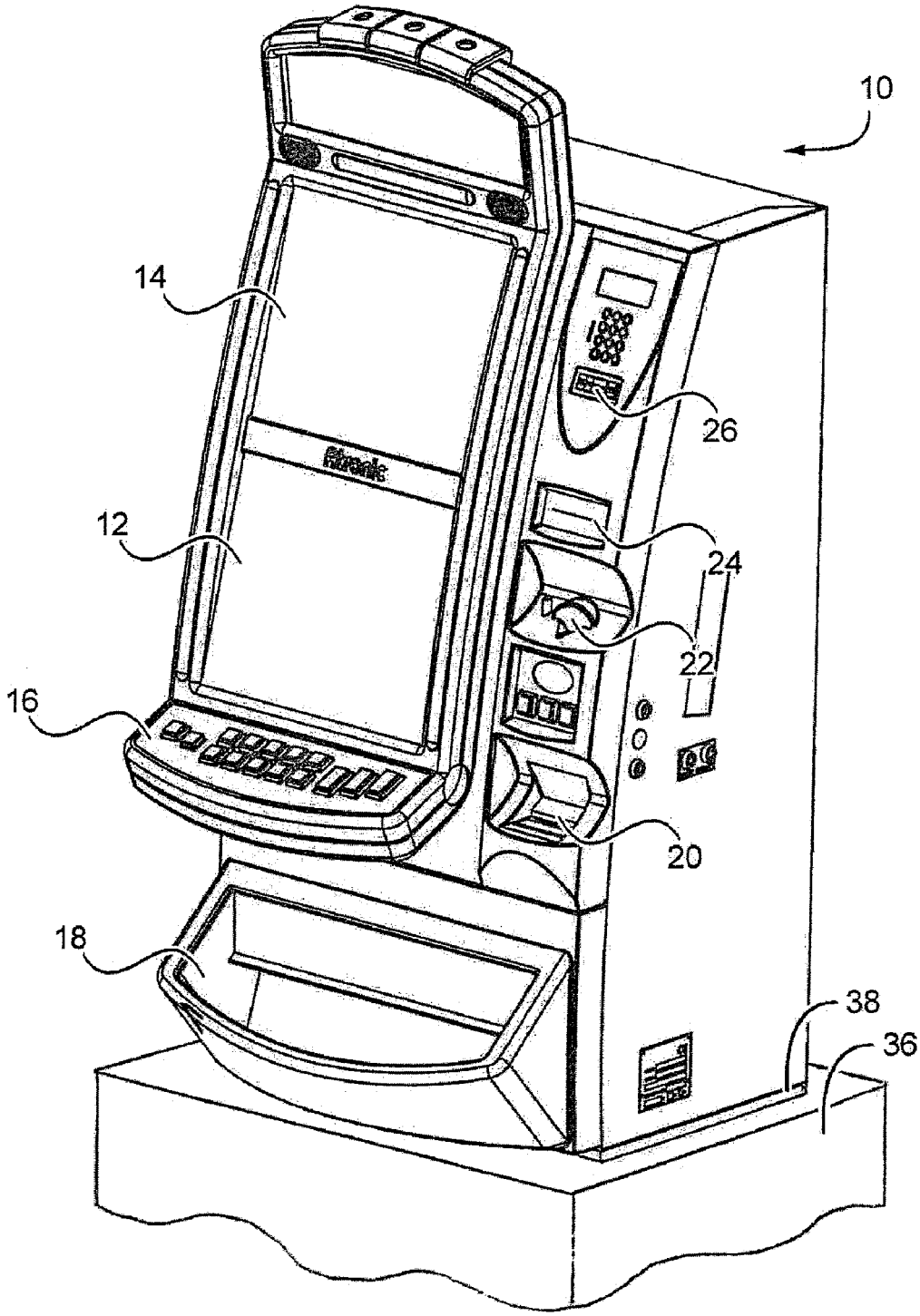
FIG. 7 illustrates the completed installation of the slot machine on the mounting bracket and the platform.

FIG. 7 illustrates slot machine 10 after coin tray 18 is secured in its final position.

Accordingly, the position of machine 10 is predetermined by the positioning of bracket 38 on platform 36, and the affixing of machine 10 to mounting bracket 38 is simple and fast, allowing easy installation and de-installation of the machine. A variety of types of slot machines are adapted to fit onto bracket 38, enabling slot machines to be quickly removed and replaced on the same bracket 38.

Figure 8:
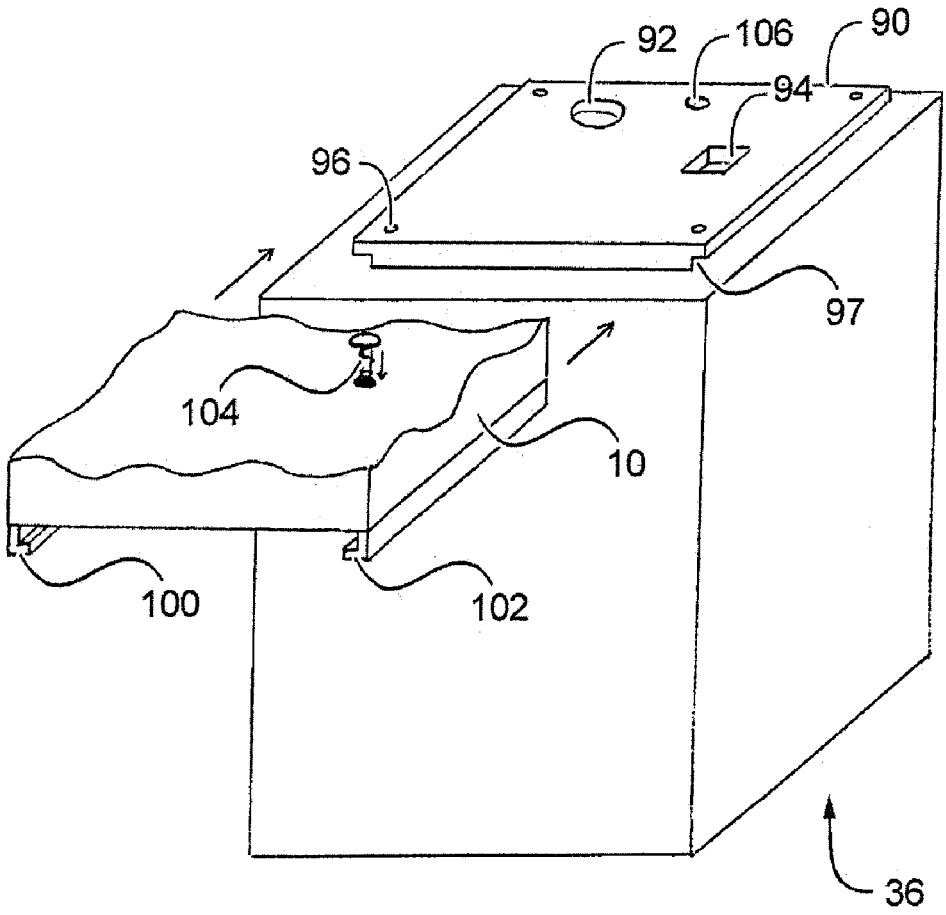
FIG. 8 illustrates another type of mounting bracket which uses a flange for slideably receiving the slot machine.

FIG. 8 illustrates another type of bracket assembly. In FIG. 8, a bracket 90 is affixed to platform 36 in a manner similar to the mounting of bracket 38 to platform 36. Hole 92 receives electrical cables and hole 94 receives coins diverted from the hopper to be dropped into a receptacle in platform 36. Platform 36 has an access means, such as a locked door, which allows an attendant access to the receptacle.

Bracket 90 has side flanges 96 and 97 for receiving corresponding L-shaped extensions 100 and 102 on the bottom of slot machine 10. Slot machine 10 is then slid into place such that the L-shaped extensions 100 and 102 slide within flanges 96 and 97. A downwardly spring-loaded pin 104 in the bottom plate of slot machine 10 automatically latches in place within bracket hole 106 when the slot machine is slid a sufficient distance over bracket 90. Thus, slot machine 10 is firmly secured in place without any tools. This allows machine 10 to be quickly removed and replaced.

Although the mounting brackets have been shown with grooves and flanges, the couplings on the bracket and slot machine may be reversed such that, for example, slot machine 10 may include grooves in its bottom surface and bracket 38 may have raised tracks.

The present invention may be used with any gaming machine.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A device comprising:

a unitary mounting bracket securing a gaming machine, the bracket being affixed to a platform for supporting the gaming machine, the bracket having first features that mate with corresponding second features on a bottom surface of the gaming machine to, at least partially, secure the gaming machine into position on the bracket, the unitary mounting bracket having dimensions approximately equal to a bottom surface of the gaming machine, the unitary mounting bracket supporting the gaming machine in a level position on the platform;

the gaming machine having secured to its bottom surface the second features, the second features being mated with the first features to align the gaming machine with respect to the unitary mounting bracket; and a securing device, only actuable by gaining access to an internal portion of the gaming machine, that secures the gaming machine to the unitary mounting bracket and prevents unauthorized removal of the gaming machine from the unitary mounting bracket.

2. The device of claim 1 further comprising the bracket having a cable hole for aligning with cable holes in the platform and the gaming machine for extending one or more electrical cables therethrough.

3. The device of claim 1 wherein the first features and second features comprise one or more grooves and one or more raised tracks for fitting into the one or more grooves.

4. The device of claim 3 wherein the first features comprise one or more grooves and the second features comprise one or more raised tracks.

5. The device of claim 1 wherein the first features and second features comprise one or more flanges and one or more extensions for fitting into the one or more flanges.

6. The device of claim 5 wherein the first features comprise one or more flanges and the second features comprise one or more extensions.

7. The device of claim 1 further comprising the bracket having a coin drainage hole for receiving coins diverted from a coin hopper in the gaming machine, the coin drainage hole for aligning with a hole in the platform.

8. The device of claim 1 further comprising the platform.

9. The device of claim 1 wherein the securing device comprises a spring-loaded latch internal to the gaming machine for automatically latching the gaming machine in place on the bracket.

10. The device of claim 1 further comprising aligning a coin drainage hole in the gaming machine, for receiving coins diverted from a coin hopper in the gaming machine, with a coin drainage hole in the bracket.

11. The device of claim 1 wherein the securing device comprises at least one screw means having a head internal to the gaming machine for securing the gaming machine in place on the bracket.

12. The device of claim 11 wherein the screw means is a bolt.

* * * * *